US007618348B2

(12) United States Patent
Hakooz

(10) Patent No.: US 7,618,348 B2
(45) **Date of Patent: *Nov. 17, 2009**

(54) COMPACT MULTIMODE DEVICE FOR LOW IMPACT THERAPEUTIC EXERCISE

(76) Inventor: Joe S. Hakooz, 204 Tobacco Farm Dr., Apex, NC (US) 27502-4858

( * ) Notice: Subject to any disclaimer, the term of this patent is extended or adjusted under 35 U.S.C. 154(b) by 848 days.

This patent is subject to a terminal disclaimer.

(21) Appl. No.: 10/872,601

(22) Filed: Jun. 21, 2004

(65) Prior Publication Data

US 2005/0282684 A1 Dec. 22, 2005

(51) Int. Cl.
*A63B 4/00* (2006.01)
*A63B 7/08* (2006.01)

(52) U.S. Cl. ..... 482/34; 482/148

(58) Field of Classification Search ..... 482/51, 482/148

See application file for complete search history.

(56) References Cited

U.S. PATENT DOCUMENTS 3,511,500 A * 5/1970 Dunn ..... 482/113
4,448,411 A * 5/1984 Parker ..... 482/34
5,575,739 A * 11/1996 Piaget et al. ..... 482/51
5,833,575 A 11/1998 Holslag
6,042,521 A 3/2000 DeGiorgis
6,244,992 B1 * 6/2001 James ..... 482/79
6,402,669 B1 * 6/2002 Olstad ..... 482/123
6,666,802 B1 * 12/2003 Rasmussen ..... 482/148
6,709,368 B1 3/2004 Chue
7,220,220 B2 * 5/2007 Stubbs et al. ..... 482/72
7,255,666 B2 * 8/2007 Cardenas ..... 482/143
2001/0036885 A1 * 11/2001 Castellot et al. ..... 482/79
2002/0117114 A1 8/2002 Byrd, Jr.

OTHER PUBLICATIONS

Zen-Pro Foot and Leg Exerciser, offered for sale by Zen-Pro Ltd of Shillingford, United Kingdom.
Chattanooga Deluxe Exerciser, offered for sale by Promed Products of Atlanta, GA, USA.

* cited by examiner

*Primary Examiner*—Lori Baker
(74) *Attorney, Agent, or Firm*—MacCord Mason PLLC

(57) ABSTRACT

An multimodal exercise device that is compact and designed for low impact therapeutic exercise allowing for multiple modes of motion for exercising or improving a user's circulation when the user places his or her feet or hands on the device's contact elements and moves them in at least one of the modes of motion. The device is preferentially used while the user is seated and can accommodate exercise in situations where exercise is not traditionally accomplished, such as at a desk, or while traveling in a plane, train, or automobile. The device includes a base, a stand, a connector, a beam, and two contact elements, configured in such a manner as to allow multiple modes of motion. Modes of motion include, but are not limited to, sliding, stepping, and cycling. Electronics integrated into the exercise device and software allow the user to monitor and/or record his or her exercise.

52 Claims, 5 Drawing Sheets

COMPACT MULTIMODE DEVICE FOR LOW IMPACT THERAPEUTIC EXERCISE

BACKGROUND OF THE INVENTION (1) Field of the Invention

The present invention relates generally to exercise devices and, more particularly, to compact low impact therapeutic exercise devices designed for increasing circulation in a user.

(2) Description of the Prior Art

Typically, a person does not or cannot exercise while they are sitting. It does not matter whether one is sitting at a desk, or traveling in a plane, train, or automobile; one does not traditionally exercise while sitting. Additionally, many people spend a majority of their time in a sitting or similar position, typically engaged in one of the aforementioned situations. Being able to exercise while sitting in a locale that one does not traditionally exercise at would be beneficial to a person.

The benefits that one could receive from being able to exercise while sitting in a traditionally non-exercising situation include, but are not limited to the following: 1) allowing low-impact office and/or therapy exercise; 2) improving blood circulation; and 3) enhancing weight control. These benefits would greatly help people who either need or want to exercise more and those who are in medical need of exercise through either a therapeutic or rehabilitation program that requires them to exercise during the day, regardless if they are sitting or not.

Furthermore, the mode of motion that a person moves his or her appendages to exercise is important. If one is sitting and performing a stepping motion with his or her feet, one is only exercising a certain subset of muscles. Likewise a different but limited subset of muscles is used for a cycling (circular or eliptical) or sliding (back and forth) motions. Additionally, being capable of alternating between different modes of exercising motion is important not only to exercise more and different muscles and muscle groups, but also to prevent an exercising person from becoming bored and uninterested in continuing to exercise.

Prior art exercise devices for use while sitting at a desk or similar locale commonly employ a stepping motion of a person's feet or at best one mode of motion for the feet, such as stepping, cycling, or sliding. However, the prior art does not appear to combine multiple modes of motion to permit one to exercise in their choice of motional mode.

An example of prior art that involves a stepping motion while sitting in a chair includes U.S. Pat. No. 6,709,368 issued to Chue, Mar. 23, 2004, for Foot Exercise Device. This patent describes a device that has two steps (i.e. pedals or levers), as the exerciser is of the stair or step variety. First one foot presses down on one step, as the other step rises. Then, the other foot pushes down on the other step, and the stepping motion is reversed. Variable resistance in the form of mini-levers is provided.

Another example of prior art that involves a stepping motion while sitting in a chair includes U.S. Pat. No. 6,042,521 issued to De Giorgis, Mar. 28, 2000, for Exercising Means. This patent describes an exercise device to enable a person to exercise his or her feet while seated. More particularly, the exercising device enables a sitting person to simulate a walking action. The exercising device has a base, a pivot beam, and two footrests. Rear parts of the footrests can pivot with respect to the base by way of ball and socket fittings, and forward parts of the footrests can pivot with respect to the pivot beam by way of additional ball and socket fittings. The pivot beam can pivot with respect to the base by way of a further ball and socket fitting. When the exercising device is in use the person can place his or her feet on the footrests and tilt both the feet and footrests from side to side. The person can also cause forward parts of the footrests to move up and down alternately by way of the pivot beam by alternately pushing his or her feet down against the footrests.

An example of prior art that involves a cycling motion while sitting in a chair includes United States Patent Application Pub. No. 2002/0107114 issued to Byrd, Jr., Aug. 8, 2002, for Rotational Exercise System, Device and Method. This patent application publication describes an exercise device that includes a frame, a cranking assembly mounted to the frame and an extended user fixture. In one implementation of the device, a user sits in a chair and places his or her feet on pedals and moves the pedals in a cycling motion to turn a flywheel.

Another example of prior art that involves a cycling motion while sitting in a chair includes the Chattanooga Deluxe Exerciser, offered for sale by Promed Products of Atlanta, Ga., USA. This portable device requires a sitting user to place his or her feet on the footrests and then pedal in a cycling motion. The device has electronic controls and an LED display that shows you information such as speed, distance, total mileage, total time "ridden", and the amount of calories burned.

An example of prior art that involves a sliding motion while sitting in a chair includes U.S. Pat. No. 5,833,575 issued to Holslag, Nov. 10, 1998, for Portable Exercise Apparatus having Chair Mountable Support Base and Variable Resistance Exercise Arms. This patent describes a portable exercise apparatus that includes a support frame having a base mountable under a chair to hold the base in a stationary position with a user seated on the chair and an upright standard mounted upon the base, a shaft mounted to an upper end of the upright standard and having opposite ends extending from opposite sides thereof, a pair of arms disposed on opposite sides of the upright standard with each arm at one end mounted to one end of the shaft for rotatably mounting the arm to the upright standard, a pair of pedals each mounted to the other end of each of the arms for engagement by a user to create the force necessary to rotate the arms relative to the upright standard, and a resistance generating and adjusting mechanism disposed on the ends of the shaft at the opposite sides of the upright standard and engaged with the one ends of the arms and being operable to generate and selectively adjust a level of resistance to rotation of the pair of arms relative to the upright standard in response to rotation of the arms.

An example of prior art that attempts to combine multiple modes of motion while sitting in a chair includes the Zen-Pro Foot and Leg Exerciser, offered for sale by Zen-Pro Ltd of Shillingford, United Kingdom. This device requires the user to place his or her feet on the footrests, then one may rotate the feet on the rests and/or rock the device side-to-side. The device is not stable as the base is curved in order to accommodate the rocking motion. Furthermore, the device's foot holders are connected directly to the base, through a ball-in-socket connector.

The prior arts do not appear to successfully combine at least the three previously discussed modes of exercising motion: sliding, cycling, and stepping. Thus, there remains a need for a compact low impact therapeutic exercise device designed for increasing circulation in a sitting user having multiple modes of motion.

SUMMARY OF THE INVENTION

The present invention is directed to an exercise device allowing for multiple modes of motion for exercising.

Preferably, the user sits down, places his or her feet or hands on contact elements, and then moves his or her feet or hands in a mode of motion, including, but not limited to, sliding, stepping, and cycling.

Thus, it is one aspect of the present invention to provide an exercise device with a base, a stand, a connector, a beam, and two contact elements; wherein the base is connected to the bottom of the stand, the stand is connected to the connector, the connector is connected to the beam, the contact elements are connected to the beam at the beam's ends, the connector provides at least a pivot motion, and the device is capable of providing multiple modes of motion for exercising when a user places each of his or her feet or hands on the contact elements for moving them in at least one of the multiple modes of motion for providing a multimodal exercise device for improving circulation of the user.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
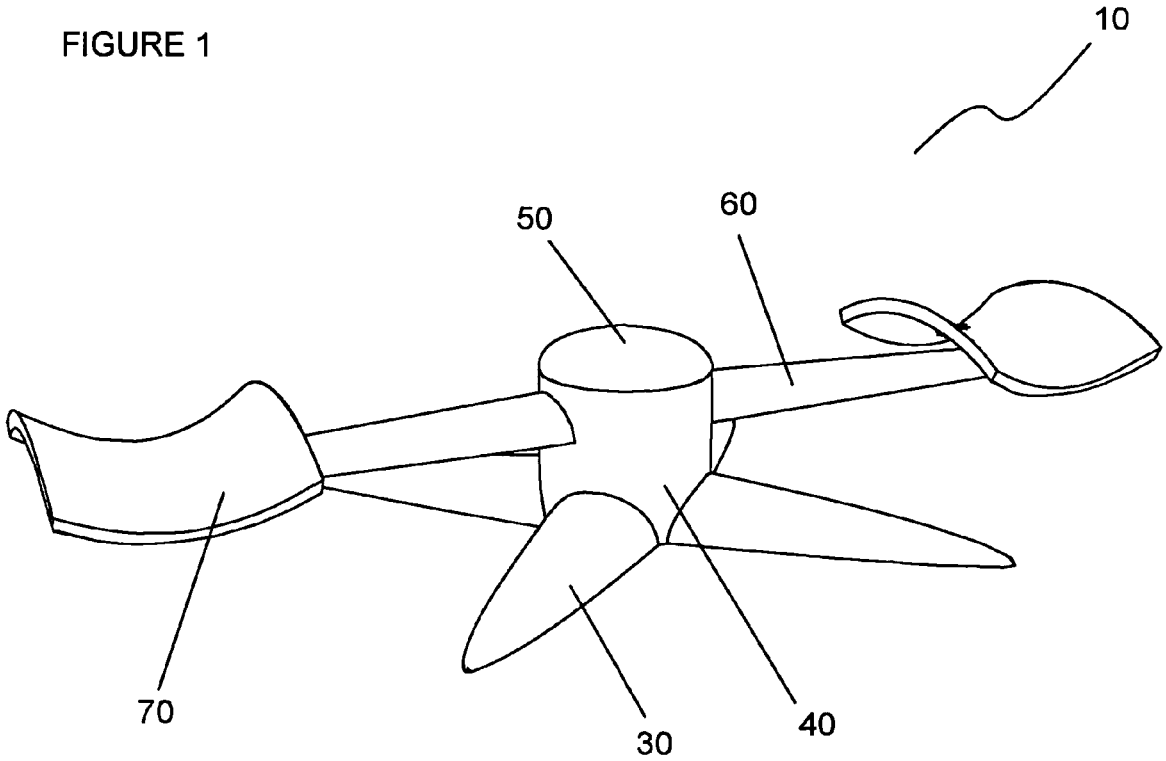
FIG. 1 is a perspective view of a device constructed according to the present invention.
Figure 2:
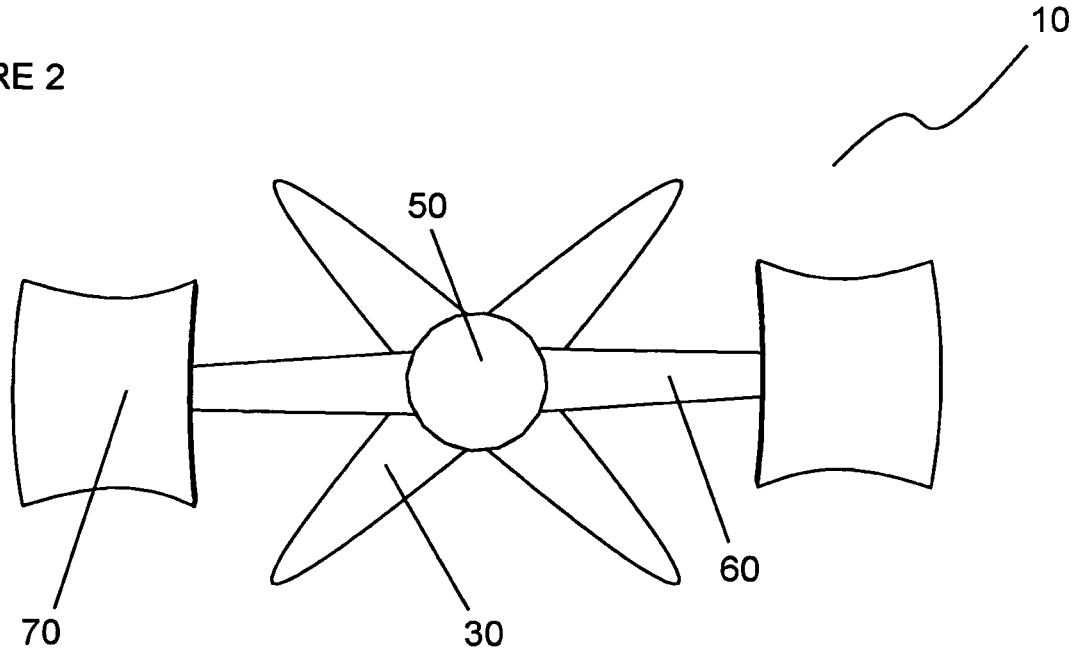
FIG. 2 is a top view of a device constructed according to the present invention.
Figure 3:
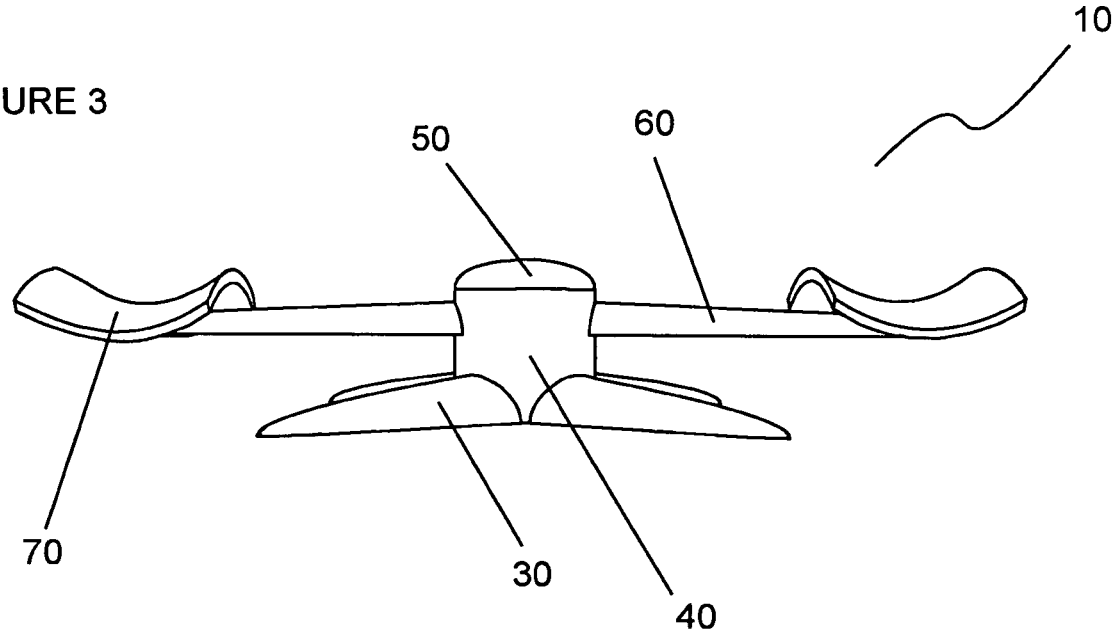
FIG. 3 is a front view of a device constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto.

As best seen in FIG. 1, the present invention, generally referred to as 10, includes a base 30, a stand 40, a connector 50, a beam 60, and two contact elements 70. The base is connected to the bottom of the stand, the stand is connected to the connector, the connector is connected to the beam, and the contact elements are connected to the beam at the beam's ends. The connector provides at least a pivot motion such that the beam may rotate in at least one direction.

Multiple Modes of Motion

The present invention provides a multimodal exercise device that is compact and designed for low impact therapeutic exercise being capable of providing multiple modes of motion for exercising when a user places his or her feet or hands on the device's contact elements 70, and moves them in at least one mode of motion. The device is preferentially used while the user is seated and can accommodate exercise in situations where exercise is not traditionally accomplished, such as at a desk, or while traveling in a plane, train, or automobile.

Figure 4:
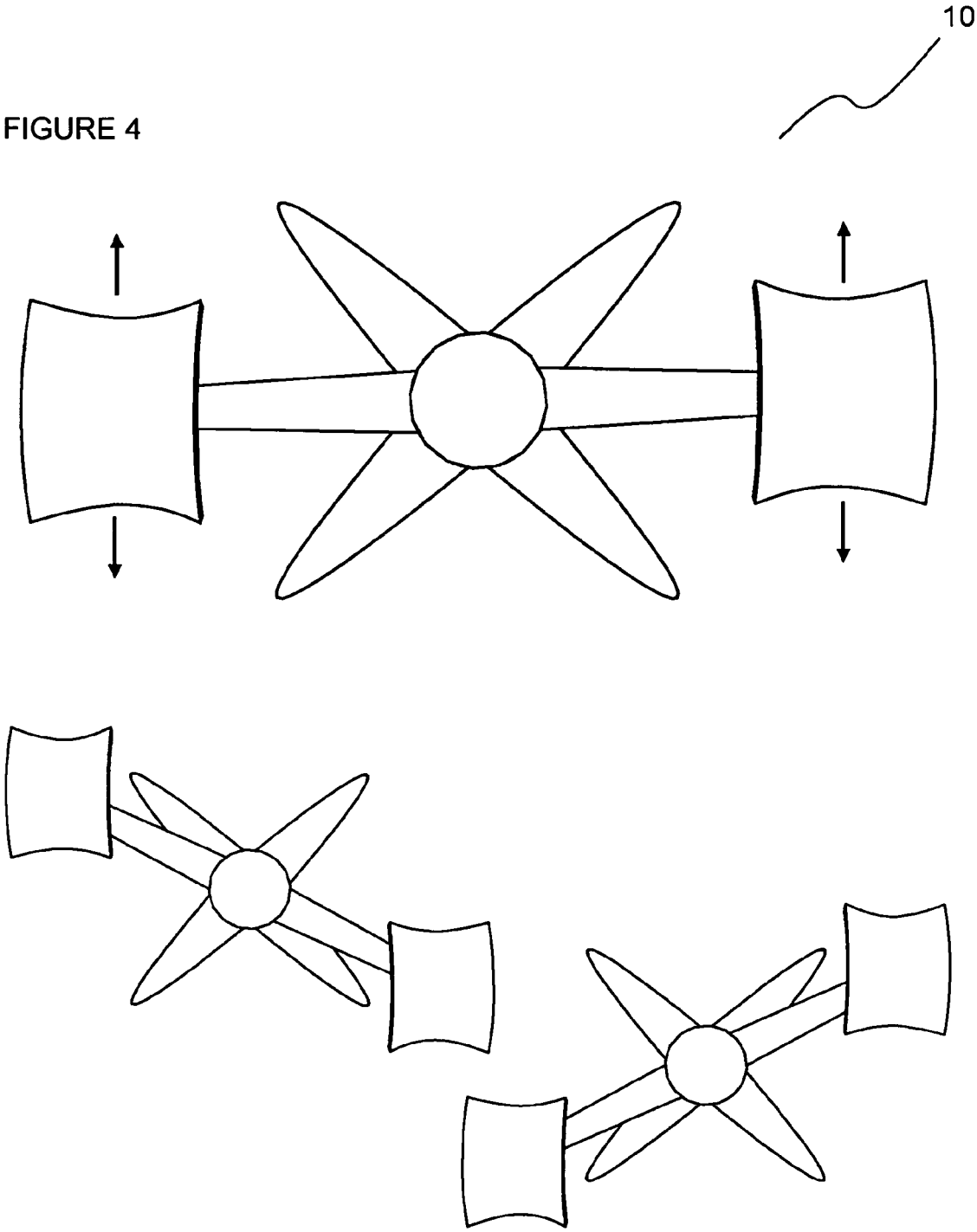
FIG. 4 is three top views of a device constructed according to the present invention demonstrating a sliding mode of motion.

Modes of motion include, but are not limited to, sliding, stepping, and cycling. As seen in FIG. 4, a sliding mode of motion is motion of at least a portion of the device wherein the contact elements move forwards and backwards, pivoting about the stand 40 at a central location of the beam 60. In the preferred embodiment of the invention, the sliding mode of motion is such that the contact elements move forwards and backwards relative to the user in a substantially horizontal plane.

Figure 5:
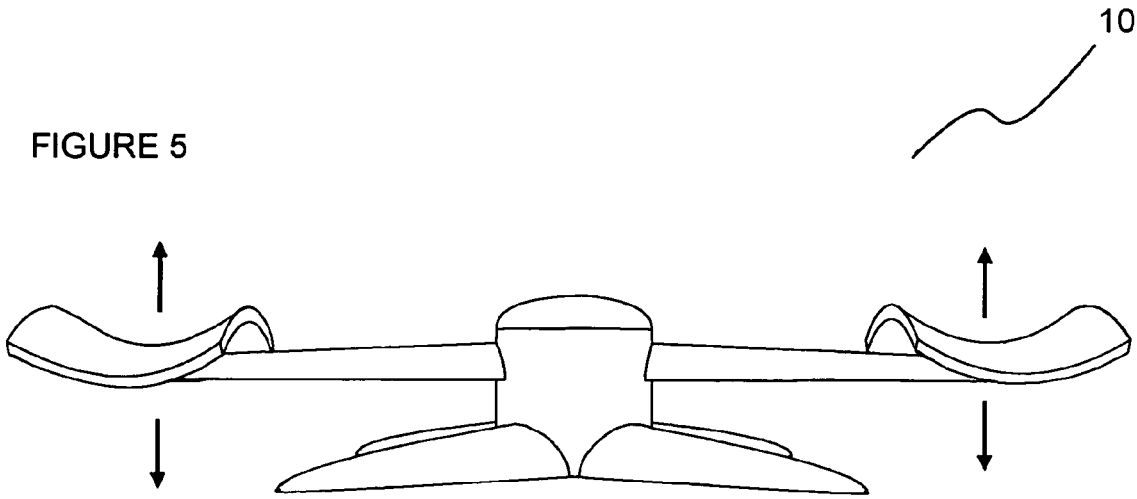
FIG. 5 is a front view of a device constructed according to the present invention demonstrating a stepping mode of motion.

As seen in FIG. 5, a stepping mode of motion is motion of at least a portion of the device wherein the contact elements 70 move up and down, pivoting about the stand 40 at a central location of the beam 60. In the preferred embodiment of the invention, the stepping mode of motion is such that the contact elements move up and down in a substantially vertical plane approximately parallel to the direction that the person using the device is facing.

Figure 6:
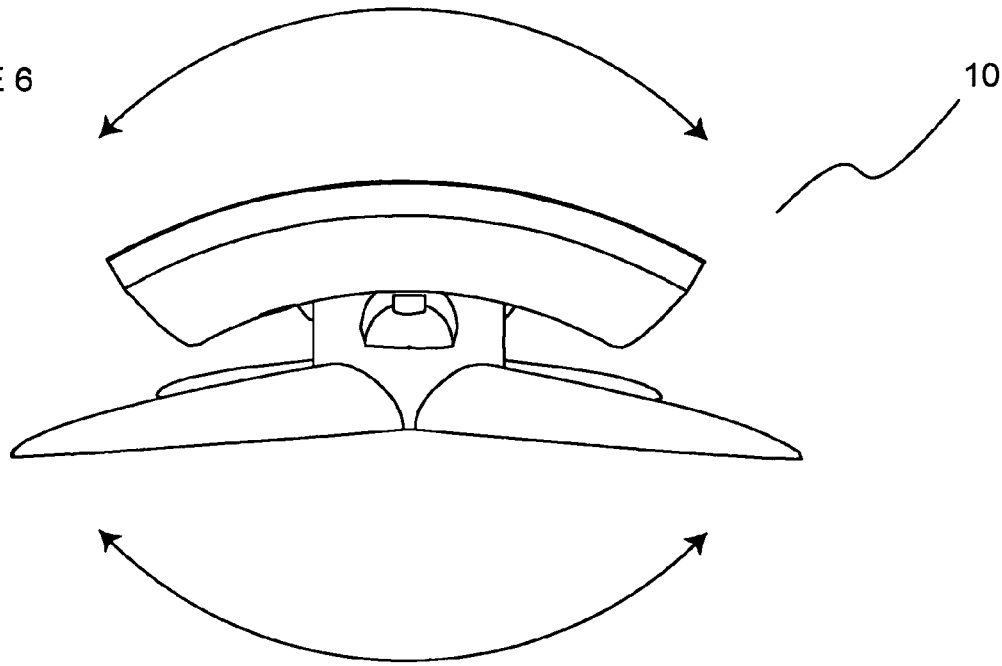
FIG. 6 is a side view of a device constructed according to the present invention demonstrating a cycling mode of motion.

As seen in FIG. 6, a cycling mode of motion is motion of at least a portion of the device wherein each contact element 70 moves in a substantially elliptical or circular pattern, pivoting about the stand 40 at a central location of the beam 60. In the preferred embodiment of the invention, the cycling mode of motion is such that each contact element moves in a substantially elliptical or circular pattern in a substantially vertical plane approximately parallel to the direction that the person using the device is facing.

The mode of motion may also be fixed such that the contact elements do not move relative to the base. This may be accomplished by locking the beam 60 or connector 50 such that neither rotates with respect to the base and/or stand. Fixing the mode of motion may provide for a user to rest his or her feet or hands on the contact elements without the contact elements moving.

The present invention may also have at least two modes of motion. These modes may be either be alternatively or selectively activatable and preferentially are selected from the sliding, stepping, and/or cycling modes of motion.

In a method for increasing circulation, the user places his or her feet or hands on the exercise device's contact elements and then moves his or her feet or hands in at least one of the multiple modes of motion. In the preferred method, the user is additionally sitting and the multiple modes of motion are either cycling, sliding, and/or stepping. These modes of motion should improve the users circulation and exercise various muscle groups providing, but not limited to, 1) low-impact office and/or therapy exercise; 2) improved blood circulation; and 3) enhanced weight control.

Structure

Figure 7:
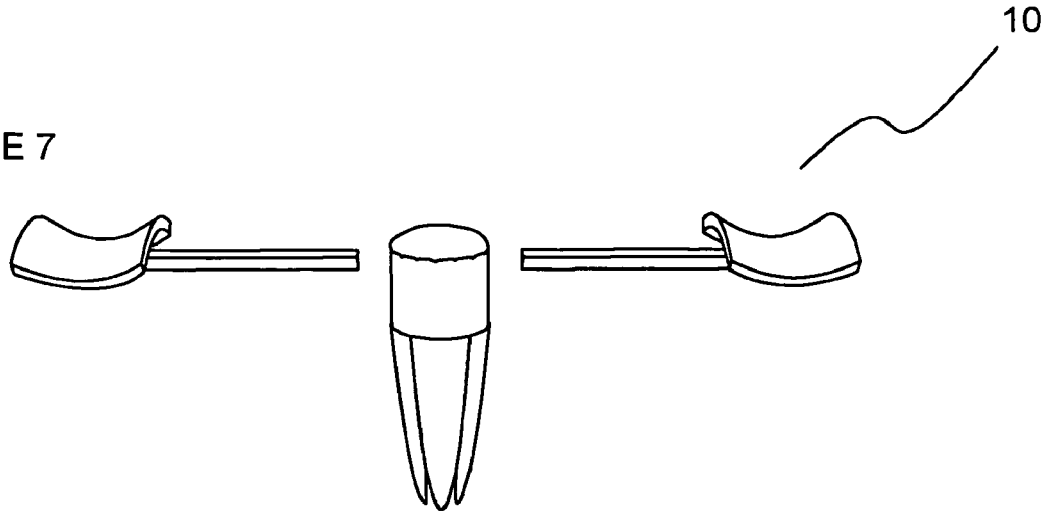
FIGS. 7-9 are front views of a device constructed according to an the present invention demonstrating collapsibility of the device into a compact form.
Figure 8:
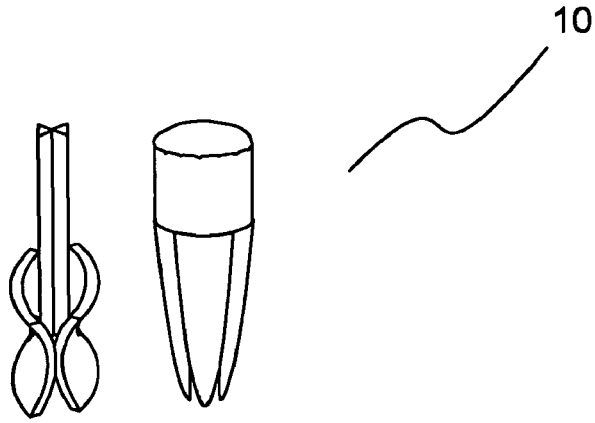
Figure 9:
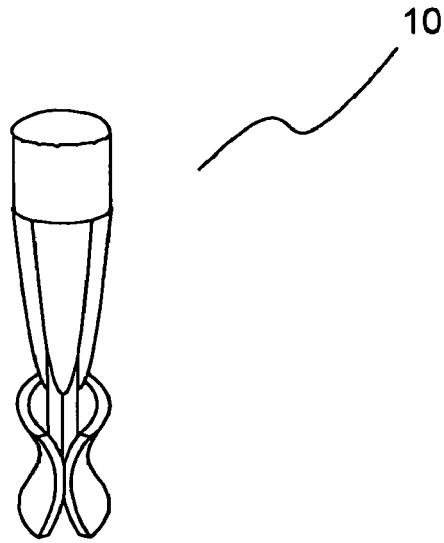

Either or both the base 30 and the beam 60 may be collapsible to accommodate storage and/or transportation of the exercise device. Such collapsibility may allow the device to compact its form. Once collapsed into a compact form, the device may fit into a cylindrical container for ease of transportation and/or storage. By way of example, FIG. 7 shows each half of the beam detached completely from the connector and the legs (base) folded downward forming a cylinder below the stand. The legs and stand are now one long cylinder. FIG. 8 illustrates how the two, now disconnected, halves of the beam can be laid flush parallel to each other forming another cylindrical shape. FIG. 9 shows how the two beams can now be inserted into the center hole created by the four collapsed legs. The remaining single cylindrical shape can be inserted into a tubular bag or case, similar to a nylon bag used to carry many folding chairs. An alternative embodiment of the present invention's collapsibility would involve rotating the two leftmost legs horizontally to the left center position parallel to the beam. Then the two rightmost legs rotate horizontally to the right center position parallel to the beam. The device may then be slid into a long but relatively skinny bag or case.

In the preferred embodiment the length of the base 30 would be between 12 and 14 inches to provide stability during use of the exercise device, yet still permit it to be compact in size. The beam 60 would be 8 inches longer than the base to accommodate the contact elements' range of motion.

The base 30 may be composed of multiple legs. The number of legs would likely be between 3 and 8. In the preferred embodiment, the base is composed of 4 legs arranged such that they intersect at approximately the central point of the bottom of the exercise device to form a cross, such as the letter X. Each leg should have a maximum length of 7 inches to keep the exercise device small and portable. Also, each leg should have enough minimum length to maintain stability of the exercise device during use. The legs may be collapsible into a compact form to accommodate transportation and/or storage.

Alternatively, the base 30 may be a unitary integral piece. Such a piece would probably be pod-like and have a footprint. The footprint of such a piece includes, but is not limited to, a triangle or a circle.

The material of the base 30 may be composed of an at least partially flexible material. Such partial flexibility could assist the device in collapsing, as explained above, and in adapting to uneven ground, as explained below. The base material may be made of rubber or rubber-like material such as the material of tire rubber. This material would be soft yet sturdy to provide for the exercise devices flexibility and support. Alternatively, the base material may be made of a harder and/or lighter material, such as a plastic, if adaptability to uneven ground is not a requirement.

The exercise device should be stable during use. This stability could be accomplished by designing the base to be adaptable to uneven ground. Making the base from a partially flexible material, such as rubber, may increase the stability of the device by allowing the base to adapt to uneven ground by flexing. Alternatively, a base pad, made of a soft material, may be added to the bottom of the base; thereby providing stability and enough friction to prevent the exercise device from slipping on the ground.

To maintain the compactness of the exercise device, the stand 40 should have a low profile. In the preferred embodiment, the stand has a maximum height of approximately 8 inches to allow for an appropriate range of motion for the contact elements, described below. Additionally, the preferred embodiment's stand has an adjustable height. This adjustability of the stand's height will allow the present invention to have a short height when required, such that the device may operate under a small desk with a keyboard tray without the user's knees contacting the desk or keyboard tray. Such shortened stand height would likely be such that the contact elements are about 2 inches off the floor and the mode of motion is restricted to sliding. The adjustability of the stand's height will also allow the present invention to be raised to its maximum height for a full range of motion of all the modes of motion when vertical space is not an issue for the user.

The connector 50 should provide at least a pivot motion. The connector may also provide a universal rotational motion. In the preferred embodiment, the pivot motion should be such that the beam 60 may rotate to accommodate at least the three different modes of motion discussed above: sliding, stepping, and cycling. Such rotation of the beam would be about the beam's approximate center and include, but is not limited to, a vertical rotation for the stepping mode of motion, a horizontal rotation for the sliding mode of motion, and a combined vertical and horizontal rotation for the cycling mode of motion.

In the preferred embodiment, the connector 50 should be approximately noiseless when the exercise device is in use so that it's use is discrete. Additionally, the connector may be flexible such that it provides tension or resistance to the user when flexed. This would increase the amount of work that the user must exert to operate the machine; thereby increasing his or her exercising benefits, discussed above. Ideally, the tension would be adjustable to allow the user to select a desired resistance.

The contact elements 70 may be connected to the beam in a variety of ways. In the preferred embodiment, the contact elements are connected to the beam with a ball-in-socket connection, such that the contact elements may pivot to accommodate a user's foot or hand at various angles.

The range of motion of the contact elements 70 should be limited such that the user would not hit his or her knees against a desk that they are sitting at during use of the exercise device. In the preferred embodiment, each contact element has less than about 4 inches of maximum vertical translation during use of the exercise device. Also, the maximum horizontal translation, combined with the maximum vertical translation of each contact element should be such that the contact elements do not hit the base 30 during use. The maximum horizontal translation may be such that the beam can rotate horizontally a maximum of 180 degrees. In the preferred embodiment, the maximum horizontal translation of each contact element is about 7 inches during use of the exercise device.

The contact elements 70 should accommodate a user's hands or feet. In the preferred embodiment, they are ergonomic to increase the comfort level of the user. The material that the contact elements are made from may be a rubber or rubber-like material such as the material of tire rubber. This material would be soft yet sturdy to provide for the contact elements' flexibility and support. Additionally, the contact elements' surfaces may be soft to increase the user's comfort and support. A soft surface could be created by coating the surfaces with a gel or rubber. The contact elements' surfaces may also be textured to increase a user's comfort. For example, the contact elements' surfaces could have bumps or ridges such that the user maintains traction on the contact elements and/or the user receives a massaging sensation on his or her feet or hands when contacting the contact elements and using the exercise device.

To increase the versatility and repairability of the exercise device, the contact elements may be removable. This would facilitate repair by allowing the user to replace the contact elements and/or potentially allow the user to mount a different set of contact elements to better fit his or her feet or hands. The removability of the contact elements could be accomplished by using a snap-fit or molded fastener to releasably attach the contact elements to the beam.

In the preferred embodiment of the device, the materials used to create the exercise device are generally lightweight to enable the device to be portable and compact. Additionally, use of the exercise device should be approximately noiseless to avoid distraction of the user and/or others during use.

Electronics and Software

A user may increase his or her benefits and/or motivation to exercise if he or she has a better understanding of the amount of work that they are doing while using the exercise device. A feedback system could be incorporated into the exercise device composed of electronics in the device linked to an external monitor, such as a personal computer which could have software running that is recording and/or displaying information that the user could access.

The electronics could be incorporated into the exercise device thereby sensing the beam's 60 or the connector's 50 movement and communicating a signal containing the information of this movement to an external monitor. In the preferred embodiment, these electronics comprise a sensor, a processor, means for communicating a signal, and a power supply or power supply connection means. The sensor is constructed and positioned to detect movement of the beam or connector. For example, the sensor could be mounted within the stand and track the beam's and/or connector's movement by using means similar to that which a joystick utilizes. The sensor, the processor, and the means for communicating a signal to an external monitor should be in electrical connection with each other and be powered by an electrical connection to the power supply or power supply connection means.

The means for communicating a signal to an external monitor can be either wired or wireless. If the means for communicating a signal to an external monitor is wired, then a cable could run from within the stand 40, down to the base, and then out through an outlet in the base. In the preferred embodiment, the cable is detachable at the outlet from the base. An example of a readily available interface to enable wired communication to an external monitor, such as a personal computer, is an USB electronic interface. If the means for communicating a signal to an external monitor is wireless, an antenna can be mounted on or within the stand.

Once the signal from the electronics of the exercise device reaches the external monitor, the signal must be interpreted and then recorded and/or accessed. An external monitor may be a personal computer, a portable computer, or a personal digital assistant (PDA). In the preferred embodiment, the external monitor is a personal computer and the interpretation of the signal is performed by software on the personal computer. The software could visually provide diagnostics of the user's exercise, such as speed, duration, distance, and calories spent. The software could allow for multiple users thereby permitting different people to use the exercise device with the same personal computer as used by an earlier user. Additionally, the software could export the information recorded from the signal by exporting the information in various spreadsheet and/or database formats, such as Microsoft Excel or Microsoft Access.

In the preferred embodiment, the software would have a graphical user interface (GUI). The GUI can have multiple designs for a customizable appearance to please the user's visual preferences. Additionally, a "skin mode" could be utilized which would compress the software's graphical representation thereby allowing the user to keep track of his or her exercise while doing other tasks on the computer.

Furthermore, the software could increase a user's enjoyment of exercising with the exercise device. The software could allow for the user to play a game that uses the signal from the exercise device to determine the user's game performance. The software could be networked with other users with similar exercise devices and software thereby allowing for competitive gaming either over a local network or the Internet.

Certain modifications and improvements will occur to those skilled in the art upon a reading of the foregoing description. By way of example: the connector, beam, and contact elements may be locked into place; the present invention could be fixed to the bottom of a seat such as an airplane or bus seat via a modified base; the present invention could be smaller than the aforementioned preferred embodiment for extremely small spaces such as a car's passenger side floor. Also, additional modes of motion not mentioned above may include, but are not limited to, vibrating and rotating such that the user's joint or joints rotate in a circular motion about the joint or joints. Modes of motion are preferably alternatively available but may be combined selectively for improved user control and safety. All modifications and improvements have been deleted herein for the sake of conciseness and readability but are properly within the scope of the following claims.

What is claimed is:

1. A device for increasing circulation in a user comprising:

a) a collapsible base, b) a stand, c) a connector including a pivot, d) a collapsible beam, and e) two contact elements;

wherein the base is connected to the bottom of the stand, the stand is connected to the connector, the connector is connected to the beam, the contact elements are connected to the beam proximate the beam's ends, and the pivot of the connector provides at least a pivot motion of the beam with respect to the stand;

thereby providing multiple ranges of motion for exercising when a person places his or her feet or hands on the contact elements and moves the contact elements in at least one of the multiple modes of motion, and wherein the collapsibility of the base and beam enable the device to be collapsed to a compact form.

2. The exercise device according to claim 1, wherein the connector provides a rotational motion.

3. The exercise device according to claim 1, wherein the base is collapsible into a compact form such that the exercise device fits into a cylindrical container when collapsed.

4. The exercise device according to claim 1, wherein the base comprises multiple legs.

5. The exercise device according to claim 4, wherein each leg has a maximum length of approximately 7 inches.

6. The exercise device according to claim 4, wherein the number of legs is 4.

7. The exercise device according to claim 6, wherein the legs intersect at approximately the central point of the bottom of the exercise device to form a cross, such as the shape of the letter X.

8. The exercise device according to claim 4, wherein the number of legs is between 3 and 8.

9. The exercise device according to claim 4, wherein the legs collapse into a compact form.

10. The exercise device according to claim 1, wherein the base is a unitary integral piece having a footprint.

11. The exercise device according to claim 10, wherein the footprint of the base is a triangle.

12. The exercise device according to claim 10, wherein the footprint of the base is a circle.

13. The exercise device according to claim 1, wherein the base has a length between 12 and 14 inches.

14. The exercise device according to claim 1, wherein the base is made of an at least partially flexible material.

15. The exercise device according to claim 1, wherein the base is made of rubber.

16. The exercise device according to claim 1, wherein the base is made from a hard and lightweight material.

17. The exercise device according to claim 1, wherein the base is made from a plastic.

18. The exercise device according to claim 1, wherein the base is adaptable to uneven ground such that the base is stable.

19. The exercise device according to claim 1, further comprising at least one base pad attached to the bottom of the base; thereby providing stability and enough friction to not slip on the ground.

20. The exercise device according to claim 1, wherein the stand has a low profile.

21. The exercise device according to claim 1, wherein the stands height is adjustable.

22. The exercise device according to claim 1, wherein the connector is approximately noiseless when in use.

23. The exercise device according to claim 1, wherein the connector is flexible such that the connector provides tension when flexed.

24. The exercise device according to claim 1, wherein the connector provides adjustable tension.

25. The exercise device according to claim 1, wherein the beam is collapsible such that the exercise device fits into a cylindrical container when collapsed.

26. The exercise device according to claim 1, wherein the total beam length is 8 inches longer than the base length.

27. The exercise device according to claim 1, wherein the contact elements are connected to the beam with a ball-in-socket connection, such that the contact elements may pivot to accommodate a user's foot or hand at various angles.

28. The exercise device according to claim 1, wherein each contact element has less than about 4 inches of maximum vertical translation during use of the exercise device.

29. The exercise device according to claim 1, wherein the beam's maximum horizontal rotation about the connector is approximately 180 degrees.

30. The exercise device according to claim 1, wherein each contact element has less than about 7 inches of total horizontal translation during use of the exercise device.

31. The exercise device according to claim 1, wherein the contact elements are made of a rubber material.

32. The exercise device according to claim 1, wherein the contact elements have a soft surface.

33. The exercise device according to claim 1, wherein the contact element surfaces are made of gel or rubber.

34. The exercise device according to claim 1, wherein the contact elements are removable from the beam.

35. The exercise device according to claim 1, wherein the contact elements are capable of being used by hands or feet.

36. A device for increasing circulation in a user comprising:

a) a base, b) a stand, c) a connector, d) a beam, and e) two contact elements;

wherein the base is connected to the bottom of the stand, the stand is connected to the connector, the connector is connected to the beam, the contact elements are connected to the beam at the beam's ends, and the connector provides at least a pivot motion;

thereby providing multiple ranges of motion for exercising when a person places his or her feet or hands on the contact elements and moves them in at least one of the multiple modes of motion, further comprising electronics wherein the electronics are incorporated into the exercise device to sense the beam's or connector's movement and communicate a signal to an external monitor.

37. The exercise device according to claim 36, wherein the electronics comprise:

a) a sensor, b) a processor, c) means for communicating a signal to an external monitor, and d) a power supply or power supply connection wherein the sensor is constructed and positioned to detect movement of the beam or connector; the sensor, the processor, and the means for communicating a signal to an external monitor are in electrical connection with each other; and the sensor and the processor are in electrical connection with the power supply or power supply connection.

38. The exercise device according to claim 37, wherein the means for communicating a signal to an external monitor is a wire.

39. The exercise device according to claim 37, wherein the means for communicating a signal to an external monitor is a USB electronic interface.

40. The exercise device according to claim 37, wherein the means for communicating a signal to an external monitor is wireless.

41. The exercise device according to claim 37, wherein the external monitor is selected from the group consisting of a personal computer, a portable computer, or a personal digital assistant (PDA).

42. The exercise device according to claim 1, wherein the exercise device is made of lightweight materials.

43. The exercise device according to claim 1, wherein the exercise device is portable.

44. The exercise device according to claim 1, wherein the exercise device is compact.

45. The exercise device according to claim 1, wherein the exercise device is noiseless during use.

46. The exercise device according to claim 1, wherein the exercise device is capable of operating in multiple modes of motion.

47. The exercise device according to claim 46, wherein the modes of motion are selected from the group consisting of sliding, stepping, cycling, vibrating, and rotating.

48. The exercise device according to claim 46, wherein the modes of motion are selectively activatable.

49. The exercise device according to claim 46, wherein the modes of motion are alternatively activatable.

50. The exercise device according to claim 1, wherein the connector, beam, and contact elements can be locked into place.

51. The exercise device according to claim 1, wherein the base is configured such that the exercise device can be mounted to the bottom of a seat.

52. The exercise device according to claim 1, wherein the exercise device is proportionately sized for small spaces.

* * * * *